US007134572B2

(12) United States Patent
Morin

(10) Patent No.: US 7,134,572 B2
(45) **Date of Patent: *Nov. 14, 2006**

(54) CONTAINER FOR A STACK OF INTERFOLDED TISSUE SHEETS

(75) Inventor: Emmanuelle Morin, Paris (FR)

(73) Assignee: SCA Hygiene Products GmbH, Mannheim (DE)

( * ) Notice: Subject to any disclaimer, the term of this patent is extended or adjusted under 35 U.S.C. 154(b) by 154 days.

This patent is subject to a terminal disclaimer.

(21) Appl. No.: 10/491,665

(22) PCT Filed: Sep. 14, 2002

(86) PCT No.: PCT/EP02/10333

§ 371 (c)(1),
(2), (4) Date: Aug. 18, 2004

(87) PCT Pub. No.: WO03/031283

PCT Pub. Date: Apr. 17, 2003

(65) Prior Publication Data

US 2004/0256404 A1 Dec. 23, 2004

(30) Foreign Application Priority Data

Oct. 3, 2001 (EP) ..... 01203742

(51) Int. Cl.
*A47K 10/24* (2006.01)

(52) U.S. Cl. ..... 221/48; 221/33; 221/47; 221/63; 206/233

(58) Field of Classification Search ..... 221/47, 221/48, 49

See application file for complete search history.

(56) References Cited

U.S. PATENT DOCUMENTS

| | | | | |
|---|---|---|---|---|
| 3,868,062 | A | 2/1975 | Rockefeller | |
| 3,986,479 | A | 10/1976 | Bonk | |
| 4,586,630 | A | 5/1986 | Loder | |
| 6,053,357 | A | 4/2000 | Yoh | |
| 6,758,369 | B1 * | 7/2004 | Morin et al. | 221/48 |
| 6,817,484 | B1 * | 11/2004 | Morin et al. | 221/48 |
| 6,905,025 | B1 * | 6/2005 | Morin | 206/494 |
| 2002/0190074 | A1 * | 12/2002 | Morin et al. | 221/63 |

FOREIGN PATENT DOCUMENTS

| | | |
|---|---|---|
| GB | 783745 | 4/1958 |
| WO | WO 97/39964 | 10/1997 |

* cited by examiner

*Primary Examiner*—Gene O. Crawford
*Assistant Examiner*—Michael K. Collins
(74) *Attorney, Agent, or Firm*—Young & Thompson

(57) ABSTRACT

A container for a stack of connected tissue-sheets has a generally planar top wall, a bottom wall and side walls connecting the bottom wall with the top wall and an opening provided in at least the top wall. The stack is placed in the container with at least a pair of edges of a lowermost tissue-sheet placed on the bottom wall and an uppermost tissue-sheet placed near or in contact with the top wall and adjacent to the opening, which is provided with elongated, overlapping projections extending from opposite sides thereof. Each projection has a tip terminating the projection before an edge of an opposing side of the opening, and the tips of adjacent projections extend past each other both in an inactive position, wherein all projections are placed in the same or in parallel planes, and in an active dispensing position, wherein the projections are turned upwards.

15 Claims, 15 Drawing Sheets

CONTAINER FOR A STACK OF INTERFOLDED TISSUE SHEETS

TECHNICAL AREA

The invention pertains to a stack of interfolded tissue-sheets packed in a container, said container having a generally planar bottom wall and a top wall and side walls connecting the bottom wall with the top wall and an opening provided in at least one wall for the removal of said tissue-sheets from the container, said stack of interfolded tissue-sheets being placed in said container with at least the edges of a lowermost tissue-sheet placed on the bottom wall and an uppermost tissue-sheet placed near or in contact with the top wall and adjacent to the opening in the top wall.

BACKGROUND OF THE INVENTION

Soft tissue sheets such as facial tissue sheets are commonly offered as a stack of tissue sheets packed in a dispensing box. The dispensing box has an opening through which the user pulls the tissue sheets. In order to facilitate the removal of the tissue sheets from the dispensing box, the tissue sheets are interfolded, which means that the tissue sheets are folded into one-another, so that they form a chain of tissue sheets being interconnected by folded portions. In this manner, when removing the top tissue sheet from the stack of tissue sheets and pulling the tissue sheet completely through the dispensing opening in the dispensing box, the pulled-out tissue sheet will automatically bring a portion of the next tissue sheet in the stack out through the opening thereby making it readily available for gripping and removing from the dispensing box. The praxis of interfolding tissue sheets in this manner is a convenient way of ascertaining that all of the tissue sheets can be easily removed from the container. There are many types of interfolding, e.g. Z-folding, but neither the type of interfolding, nor the type of tissue is important to the invention.

A dispenser of this type is known from U.S. Pat. No. 6,053,357 (YOH), which discloses a box with a dispensing opening having a curvilinear or "S"-shape. The opening facilitates the dispensing of interfolded tissues from a box by fixing the top sheet in a position extending out through the opening, where it is readily accessible to a user.

The European patent application EP 00203753.9 discloses a box for dispensing a flat tissue sheet from the stack of tissue sheets. To dispense a flat tissue sheet it is necessary to have a wider opening in the box. Although a wider opening in the box solves the problem with tissues being wrinkled as they are pulled out of the box, it creates a further problem with tissues falling back into the box where they are inaccessible for the user. This problem is solved by providing the opening with opposing projections which supports the flat tissue sheet in a presentation position.

However, in the case of soft facial tissues, handkerchiefs and tissues made from a relatively thin material, the arrangement of opposing projections is not sufficient to keep a tissue in an upward presentation position. A standard box for dispensing tissues of this type is usually provided with an opening having an extension in the direction of the main axis of the box. After opening the dispensing box, which basically means exposing the opening in the box, the user must try and get a grip on the first tissue sheet in order to remove it. After a tissue has been removed, the uppermost tissue is usually wrinkled is a random fashion when it is presented to the user through the opening in the box. The reason for this is that the width of the tissue is broader than the opening in the box, in order to fix the tissue in a position ready to use. At the same time the random presentation position often makes it difficult to get a good grip on the tissue or to grip the edge of the tissue being presented.

Hence, there exists a great need of improving the dispensing of soft tissue sheets from a stack of tissue sheets, which are packed in a dispensing box.

DISCLOSURE OF THE INVENTION

The present invention offers a simple and expedient means of solving the problem of dispensing a soft tissue sheet from a stack of interfolded tissue sheets which are packed in a container having a dispensing opening. In a preferred embodiment, the opening is narrower than the width of said tissue sheets. The invention will, however, also be applicable for openings of equal or wider width than the width of the tissue sheets.

In accordance with the invention the dispensing opening is provided with means for presenting a tissue blocked in a fixed position, with a controlled wrinkled configuration. This allows the user to pull the presented tissue out flat from the controlled wrinkled position in which it is held by the presenting means. The presented tissue may be a single sheet, or may itself have additional folding.

The means for presenting the tissue is preferably in the form of a number of elongated projections or fingers extending from opposite sides of the dispensing opening of the box. The dispensing opening is preferably, but not necessarily, located in the top wall of the box. In order to fix a tissue in position the fingers are overlapping by extending between each other. In the following text, the term "overlapping" is used in the context of projections or fingers extending from opposite directions, placed adjacent and in between each other, as seen in the plane of the top wall. Similarly, the term "opening" is assumed to encompass the general area delimited by any cut-out sections, projections, folding lines and perforated edges in the top wall.

In order to hold a tissue in a dispensing position, each projection has a tip terminating the projection before an edge of an opposing side of the opening, and the tips of adjacent projections extend past each other both in an inactive position, wherein all projections are placed in the same or in parallel planes, and in an active dispensing position, wherein the projections are raised upwards to grip a tissue As the box is opened the fingers are initially arranged in substantially the same plane, or in adjacent parallel planes, until the first tissue has been extracted through the dispensing opening. The fingers may be attached to the underside of the top wall of the box, on opposite sides of the opening. It is also possible to integrate them into the top wall itself, e.g. by making the fingers part of the top wall. This can be done by making a blank having a complete set of fingers punched or cut in a single wall, or two sets of opposing fingers punched or cut in separate walls which will overlap when the box is assembled. The stiffness and/or the point where the fingers are intended to bend is controlled by a folding line at or near the base of the fingers. The folding line is preferably, but not necessarily, made by some form of embossing operation. The embossed lines can be made at the same time as the fingers are cut, or in a subsequent operation.

When the first tissue is being pulled out through the opening, the fingers will be raised upwards by the tissue on either side thereof. The pulled-out tissue will automatically bring a portion of the next tissue out through the opening, where it will pass between the fingers. As the first tissue is removed, the following tissue will be held in position and prevented from falling back into the box by the gripping action of the opposing fingers. The fingers must be sufficiently flexible to allow a tissue to be pulled out, while at the same time being sufficiently stiff to retain the tissue and prevent it from falling back into the box. In their active position the fingers extend upwards, with the tips of adjacent opposing fingers extending between and past each other. This causes the tissue to be presented to wrinkle in a controlled manner, as it is shaped by the fingers while being pulled from the box. Adjacent projections can impart a substantially sinusoidal cross-sectional shape to the tissue in the region of the tips. Accordingly, the thickness and stiffness of a plastic film, cardboard or other suitable material, used for the fingers must be selected to match the softness and material properties of the tissue.

The sides of the fingers or projections may either be parallel or tapering towards their tips. In the case of projections with parallel sides, a maximum width is determined by the desired stiffness of the projections. Similarly, a maximum angle enclosed by two sides of a tapering projection is also determined by the desired stiffness. Obviously, an increased width or enclosed angle will give the projection both a reduced flexibility along its length, as well as an increased stiffness in the region of a folding line at or near the base of the projection.

The overlapping fingers or projections may be arranged extending from opposite sides of the opening, past and with their main axes at an angle relative to the main longitudinal axis of the opening. The fingers on the same side of the opening can be angled in the same direction or be angled away from each other on either side of a central, transverse plane through the middle of the opening. This first angle of the fingers may be constant or increase/decrease with the distance from said transverse plane.

In a preferred embodiment the fingers are angled between 60° and 90° relative to the main longitudinal axis of the opening.

In a further preferred embodiment the fingers are positioned at right angles relative to the main longitudinal axis of the opening.

In the above cases, said first angle of the fingers is defined as the angle between the longitudinal axis of the opening and a main axis, or centreline, through the finger or projection. Also, all angles referred to are taken in the inactive position of the fingers or projections, unless otherwise specified.

In order to avoid interference between pairs of adjacent projections or fingers, it is important that they do not come into contact with each other when raised to their active, dispensing, positions. The purpose of the projections is to achieve a controlled wrinkling of a tissue sheet to be dispensed, whereby the tissue sheet itself is supported by the individual projections without any assistance from a gripping action between adjacent projections.

For projections or fingers positioned at right angles relative to the main longitudinal axis of the opening, whether their sides are parallel or tapered, the desired function may achieved by means of a folding line either parallel to said longitudinal axis or following the general edge of the opening, as long as the angle between the main axis of each finger and the folding line fulfils certain conditions (see below). Such fingers or projections can be identified by the fact that a perpendicular line through the longitudinal axis at the point where the edges of a pair of adjacent fingers cross said axis will not intersect said fingers. In other words, said perpendicular line will cross the outer edge of each finger only once.

However, fingers or projections with their main axes angled relative to the main longitudinal axis of the box may risk interference when raised to the dispensing position. Such fingers or projections can be identified by the fact that a perpendicular line through the longitudinal axis at the point where a the edges of a pair of adjacent fingers cross said axis will intersect said fingers. In other words, said perpendicular line will cross the outer edge of each finger more than once. In such cases the angle of the folding line with respect to the main axis of the finger may need to be adjusted.

In the latter case, the folding line, which determines where each finger or projection folds, should be positioned at an angle which is at or near right angles to the main axis of the respective finger or projection. This angle may vary, from being at or near right angles the main axis of a finger to being at or near right angles to a tangent to the edges of the finger and an adjacent finger at a common line or point of contact in the region of the area where the tangent intersects the longitudinal axis of the opening. Hence, the range within which said angle may vary is substantially equal to the difference between the angle of the finger or projection and the angle of said tangent with respect to the longitudinal axis of the opening. By definition this range can vary from a minimum value of 0°, for fingers with parallel edges, to a maximum value as said tangent approaches an angle of 90° to the longitudinal axis of the opening. The range must be determined for each individual finger, which will be described in detail below.

Using fingers or projections having said first angles less than said 60° may be possible. However, due to side forces imposed on the fingers by a tissue sheet being pulled from the box, interference between adjacent fingers may occur even if the above conditions are met.

Apart from the positioning of the folding lines, the risk of interference between adjacent opposing projections can also be reduced by a number of other factors. One such factor is the enclosed angle of a tapering projection, whereby an increased enclosed angle will increase the space between projections in their active positions and reduce the risk of interference. Using a double, spaced cut or punched line between adjacent projections will give the same effect for tapered as well as for straight projections having parallel edges.

According to a further embodiment, the above folding lines may be replaced by folding areas. Whereas a folding line has a very limited extent in its transverse direction, a folding area will extend a short distance in the general direction of the projection or finger. Said folding area defines an area within which a projection may flex when subjected to a force. However, such areas will also have a general controlled direction of folding, in the same way as an embossed folding line. The above angles defining how a projection should bend or flex will therefore apply to folding areas in a similar way. A folding area can be achieved by embossing, or some other mechanical pressing operation, resulting in an area having a number of desired mechanical an resilient properties.

According to a further embodiment, all fingers are made as a part of the top wall, whereby the fingers are defined by a single punched or cut line through said top wall. This line is continuous and defines the outline of all projections and openings or removable cut-outs in said wall. The cut line will need to be broken intermittently in order to keep cut-out sections, etc., in position until they are removed. In this case parts of the opening is also defined by a number of embossed folding lines at or near the base of the fingers. This embossing can be used to control the stiffness of the fingers.

According to a further embodiment, the container is provided with two sets of opposing fingers, wherein each set of fingers is placed separate but adjacent planes. In this case the container is erected from a blank folded to give a top wall having two layers. A first set of fingers are part of an upper top wall and that a second set of fingers, opposing said first set, are part of a lower top wall. Both the first and second sets of fingers are defined by a single cut line through their respective top wall, which line has been cut in the blank prior the assembly of the box. The upper top wall may have a removable cover section, which corresponds to the shape of the set of fingers in the lower top wall and which has been cut or punched in the upper top wall. This cover section is removed by the user when the container is first opened, in order to expose the second set of fingers and their associated folding lines in the lower top wall.

According to an alternative embodiment of the above container, both sets of fingers and their associated embossed folding lines are part of said lower top wall, while the upper top wall is provided with a cover section. This cover section has the same general shape as the embossed folding lines in the lower top wall, but is slightly larger and is perforated around its circumference. In order to open the container, the cover section is torn of to expose the fingers and the embossed folding lines in the lower wall.

According to a further embodiment, all fingers or projections are provided as a cut or punched line in an insert attached to the underside of the top wall. In this case the opening has been cut directly in said top wall. The top wall may include a cover section integrated with said top wall. The cover section has a perforated line around its periphery and is removed when the box is opened, in order create an opening that exposes the fingers and their folding lines.

According to a final embodiment, the edge of an opening in the top wall may fulfil the function of the embossed folding lines. In this way the stiffness and point of bending of the fingers would be determined by the position of the edge of the opening itself.

SHORT DESCRIPTION OF FIGURES

The invention will in the following be described in greater detail, with reference to the figures which are shown on the appended drawings. In the drawings.

These drawings are only schematic and are not drawn to scale. They do not limit the scope of the invention in any way.

DETAILED DESCRIPTION OF EMBODIMENTS

Figure 1A:
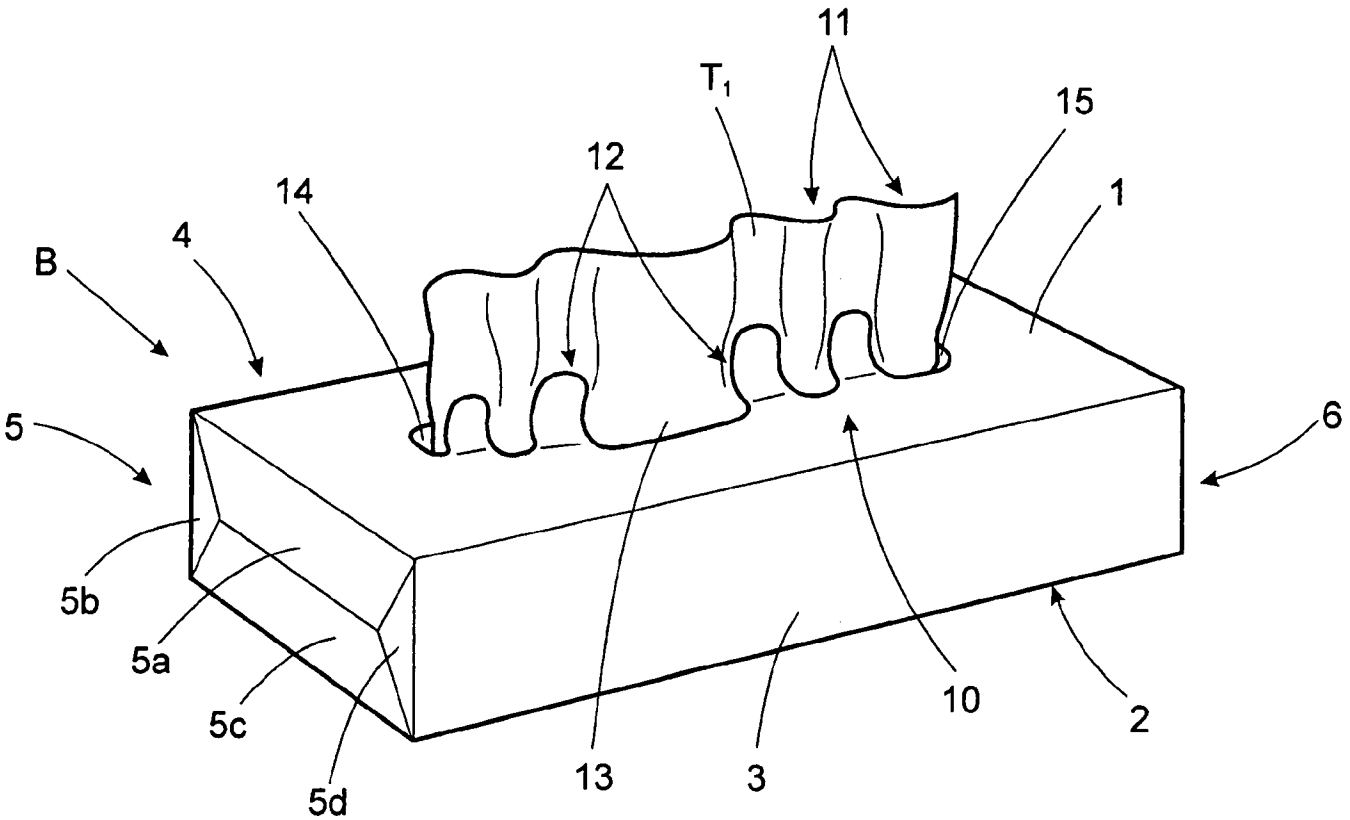
FIG. 1A shows a box containing a stack of tissues in accordance with a first embodiment of the invention.
Figure 3:
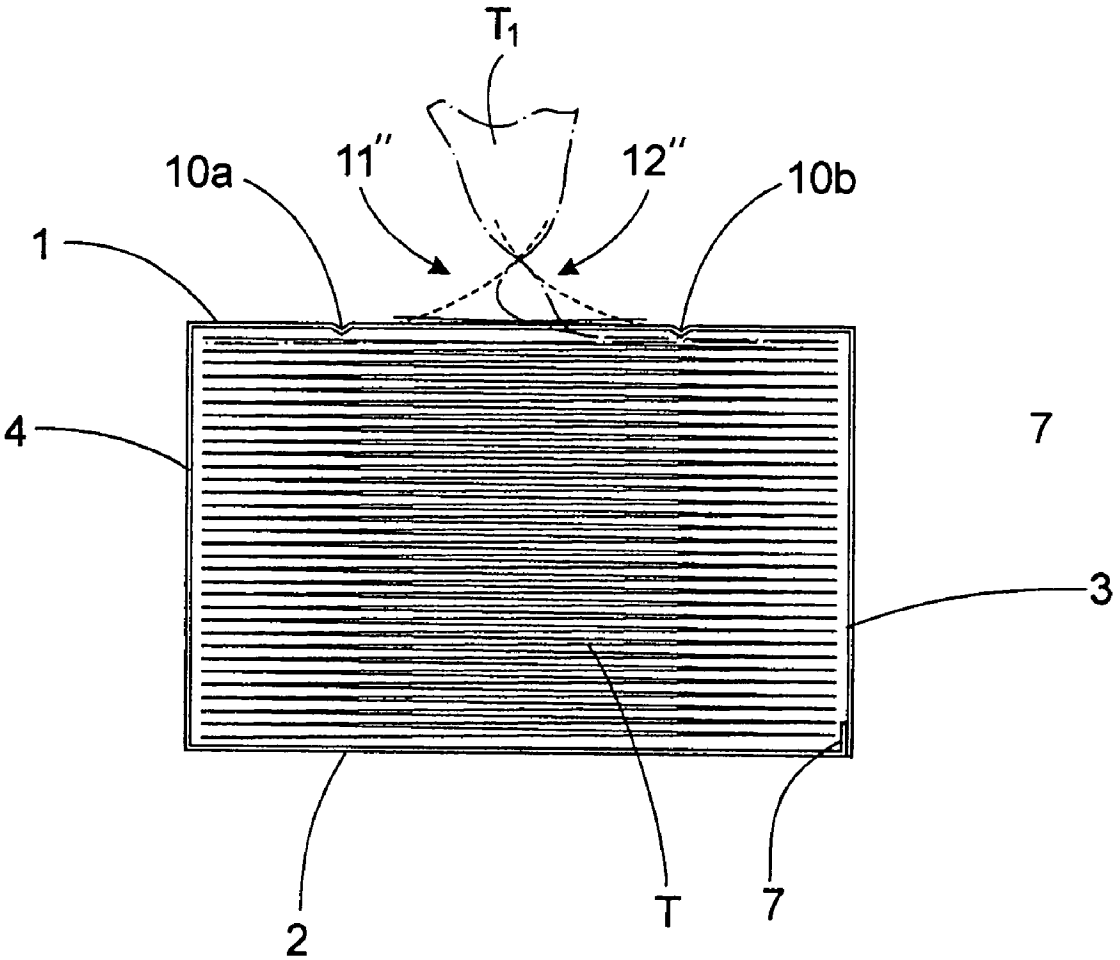
FIG. 3 shows a cross-section of a box containing a stack of tissues in accordance with the first embodiment of the invention.

FIG. 1 shows a generally rectangular paperboard dispensing box B containing a stack of interfolded tissue-sheets. By interfolding, all the tissue-sheets in the stack are mechanically connected to each other in a continuous, loosely connected band of individual tissue-sheets. The paperboard box has a top wall 1, a bottom wall 2, two long side walls 3, 4 and two short side walls 5, 6. The short side walls 5, 6 are each made up of four individual flaps 5*a*, 5*b*, 5*c*, 5*d* and 6*a*, 6*b*, 6*c*, 6*d* (not shown). Each flap is part of the respective top and bottom walls and the long side walls, and extend from the shorter side edge of said walls. When a pre-cut blank is erected to form a container, the flaps are folded to make side walls in a conventional manner. The stack of tissue-sheets rests with a lower-most tissue-sheet on the inner surface of the bottom wall 2 and has a height substantially corresponding to the height of the box B, that is, to the height of the side walls 3–6. It is to be understood, that the height of the stack of tissue-sheets is to a certain degree determined by the height of the box. The interfolded tissue-sheets are highly compressible and are usually, but not necessarily, compressed before being placed in the box, so that a sufficient amount of tissue-sheets can be accommodated in the box. FIG. 3 shows a cross-section of such a box containing a stack of tissues T.

The box B is provided with an opening 10 in the top wall 1. The opening 10 is arranged generally centrally in the top wall 5 and extends parallel to the first and second long side walls 3, 4. Extending from the sides of said opening 10 are two sets of opposed projections 11, 12. FIG. 1 shows an arrangement with two sets of four projections, of which only one set is visible. The function of these projections will be described in detail below. The opening 10 has a generally offset oval shape with a central opening 13, rounded ends 14, 15 and slightly outwardly curved side edges, so that the opening 10 is wider at a central portion than at the ends. The opening will be described in further detail below. Before use of the box of tissue-sheets, the opening 10 is commonly protected by a cover. Usually the protective cover is made of the same paperboard material as the box itself, and is simply a portion of the top wall 1, which can be torn away along a perforated line in the top wall 1. However other protective devices such as separate pieces of paper, paperboard, plastic film, and the like can be envisaged. Moreover, the box can be provided with a permanently attached or removable regular lid which is opened to expose the opening in the top wall 1 and which, optionally, can be re-closed. Such a lid may cover all or part of the top wall 1. When in use, the uppermost tissue $T_1$ is gripped by the projections in a dispensing position.

Figure 1B:
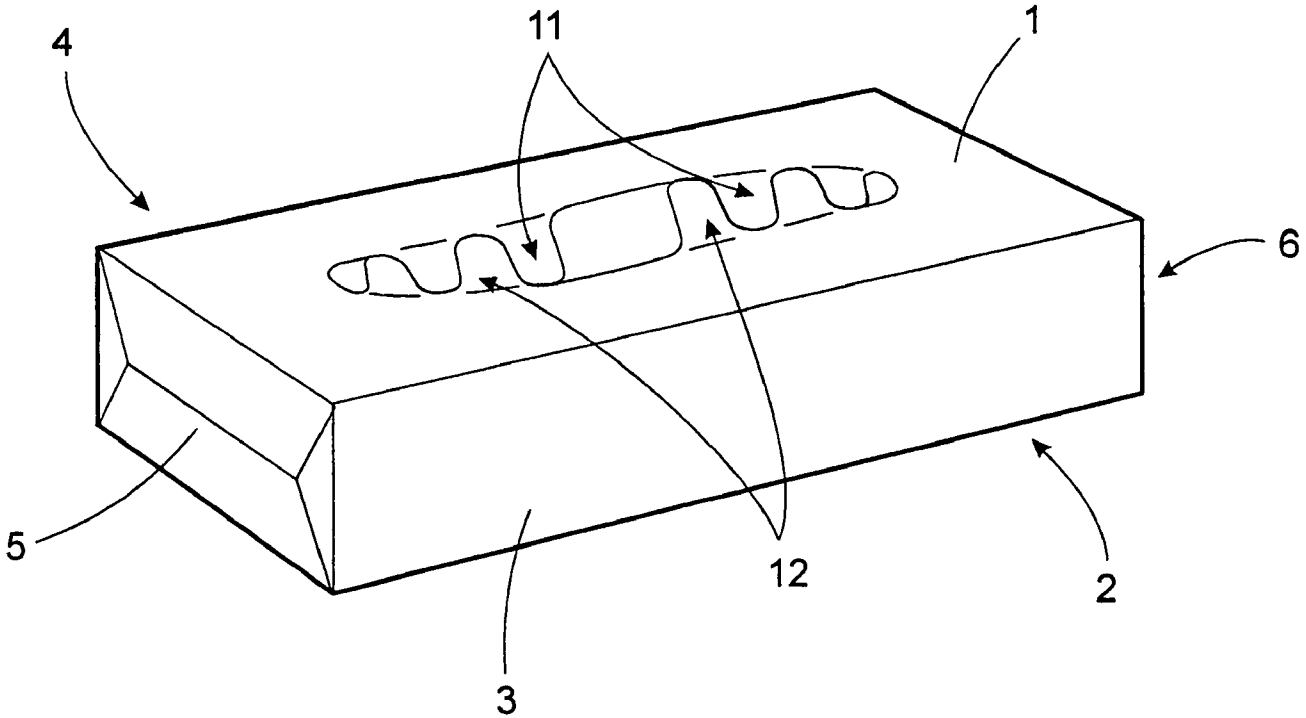
FIG. 1B shows an unopened box containing a stack of tissues in accordance with a first embodiment of the invention.
Figure 1C:
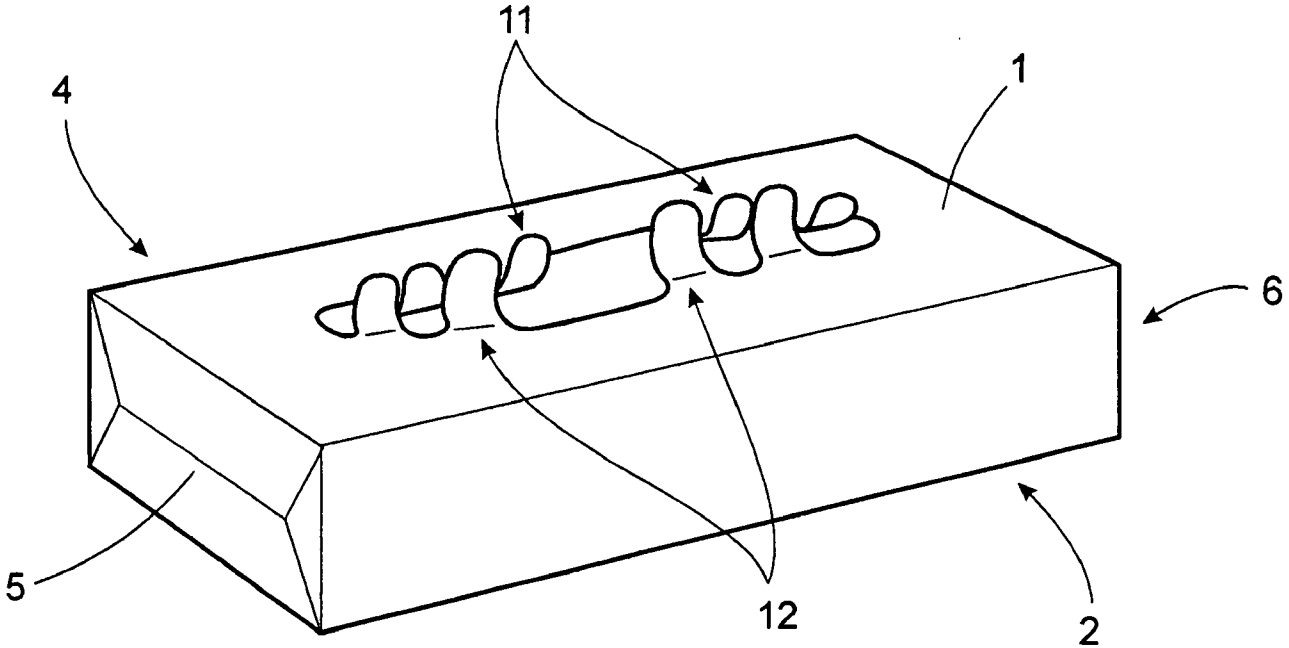
FIG. 1C shows an opened box containing a stack of tissues in accordance with a first embodiment of the invention.

FIG. 1B shows an unopened box with the opposed sets of projections 11, 12 in their inactive positions. FIG. 1C illustrates an opened box with the projections in their active positions. This figure is identical to FIG. 1A, but shown without a tissue sheet to obstruct the view of the opposing set of projections.

Figure 2:
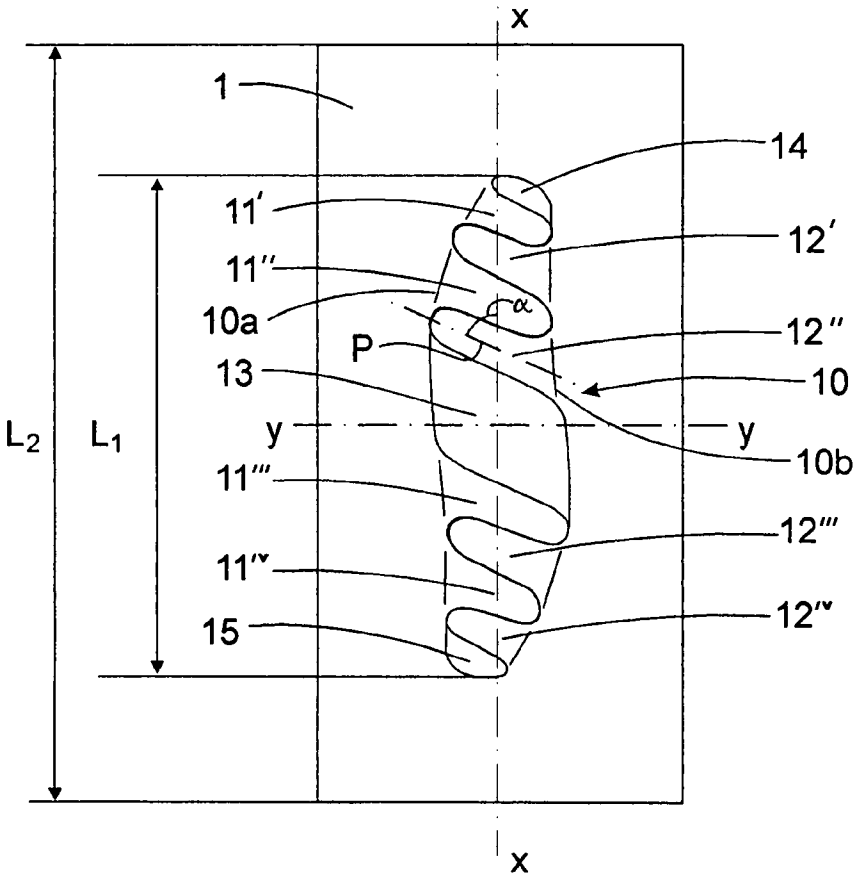
FIG. 2 shows a plan view of a box according to the first embodiment of the invention.

Moreover, the opening 10 in the top wall 1 need not have the described oval shape. Hence, rectangular openings, circular openings or openings having irregular shapes are contemplated within the scope of the invention. The exact shape of the opening can be altered to give the projections the properties required by the type of tissue to be dispensed. Common for the openings, however, is that they extend substantially along a central longitudinal axis X across the top wall, as indicated in FIG. 2. The opening is either inversely symmetrical, as seen in FIG. 2, or symmetrical on both sides of a transverse axis Y through the box. The length $L_1$ of the opening in the longitudinal direction of the box is preferably, but not necessarily, shorter than the length $L_2$ of the box.

According to the embodiment of FIG. 2, the opening is provided with a number of positioning means in the shape of projections or fingers to prevent the soft and pliable tissue from falling back into the box. The projections extend from opposite directions of the opening, and are placed adjacent or in between each other, as seen in the plane of the top wall. This can be seen in FIG. 2, which shows a plan view of a box with its projections in flat, non-active positions, and in FIG. 3, showing the projections lying in the same plane as the top wall. The tips of the adjacent projections extend past each other both in their active and their non-active positions. The base of each projection, as defined by an interpolated line or curve connecting the tips of each set of opposing projections, defines the opening 10. An embossed folding line is provided at or near the base of each projection, in the vicinity of said interpolated line. The folding lines 10*a*, 10*b* determine the position where each projection will bend. In the preferred embodiment, the projections 11'–11$^{iv}$; 12'–12$^{iv}$ are slightly tapering towards their tips. The tips of the projections are preferably rounded, but can be given any suitable shape within the scope of the invention.

According to an alternative embodiment, the projections may also have a constant width along a major part of their length.

As can be seen from FIG. 2, the overlapping projections 11'–11$^{iv}$; 12'–12$^{iv}$ are arranged extending from opposite sides of the opening, past and at an angle α relative to the main longitudinal axis X of the opening. The angle α is measured between said longitudinal axis X and the centreline or main axis P of each projection The projections on the same side of the opening are angled in the same direction on either side of a central, transverse plane Y through the middle of the opening. In this embodiment the angle α of the projections is the same throughout for all projections 11'–11$^{iv}$; 12'–12$^{iv}$ on both sides of the opening.

In a preferred embodiment the projections are arranged at an angle α between 80° and 90° relative to a centreline or main axis P of each projection and the main longitudinal axis X of the opening.

In a further preferred embodiment the projections are positioned with their centrelines at right angles relative to the main longitudinal axis X of the opening 10.

It is also possible to allow the angle α to decrease with the distance from said transverse plane Y. According to this embodiment, the angle α could decrease from 90°, or near 90°, towards 80°.This would of course give each consecutive finger a different tapering shape. In a further embodiment, the projections may be angled symmetrically away from each other on either side of the transverse plane Y, with a constant angle α.

FIG. 2 shows a plan view of the overlapping projections in their initial, inactive position, before the first tissue-sheet has been pulled out of the box. In this case the positioning means comprises two sets of projections 11', 11", 11''', 11$^{iv}$; 12', 12", 12''', 12$^{iv}$ placed opposite each other on either side of the opening 10. As can be seen from FIG. 2, the uppermost tissue-sheet can be accessed through a cut-out in the shape of a central opening 13 between the two opposite edges of the opening 10 and the two projections 11''' and 12''' nearest the central transverse axis Y. On either side of this central opening, the projections are positioned at a predetermined angle α relative to the longitudinal axis X. Similarly, a pair of cut-outs 14, 15 are provided at either end of the opening 10, between its ends and the outermost projections 11', 12'. The above cut-outs 13, 14, 15 will be removed as a user opens the box to expose the projections.

The removal of said cut-outs can be achieved by attaching them to the underside of a cardboard or plastic sheet covering the opening itself, or a lid covering the entire top wall.

The example shown in FIG. 2 discloses an embodiment with four projections extending from each side of the opening. It is of course possible to vary the number of projections within the scope of the invention. As well as providing an even or an odd number of projections on either side of the transverse axis Y, the number of projections on each side of the opening may be varied from two up to e.g. six. Larger numbers are possible, but not practical due to the length of the opening required by an increased number of projections.

The embodiment of FIG. 2 also shows projections 11', 11"; 11''', 11$^{iv}$; 12', 12"; 12''', 12$^{iv}$ which are gradually shortened in the direction away from the central opening 13. This is due to the substantially oval shape of the opening 10, which requires the length of each subsequent projection to be shorter to conform to the shape of the opening, or in this case the embossed folding lines 10*a*, 10*b* representing the edge of the opening 10. As stated above, these folding lines determine where the fingers will bend, as they are raised to their dispensing positions.

Within the scope of the invention it is of course also possible to vary the length of the projections in the opposite direction, or to use projections having a constant length. Such variations can also be made depending on the shape of the opening 10 itself, which shape may be varied freely within the scope of the invention. Examples of such embodiments will be described in connection with FIGS. 4*b* and 4*c* below.

Figure 6:
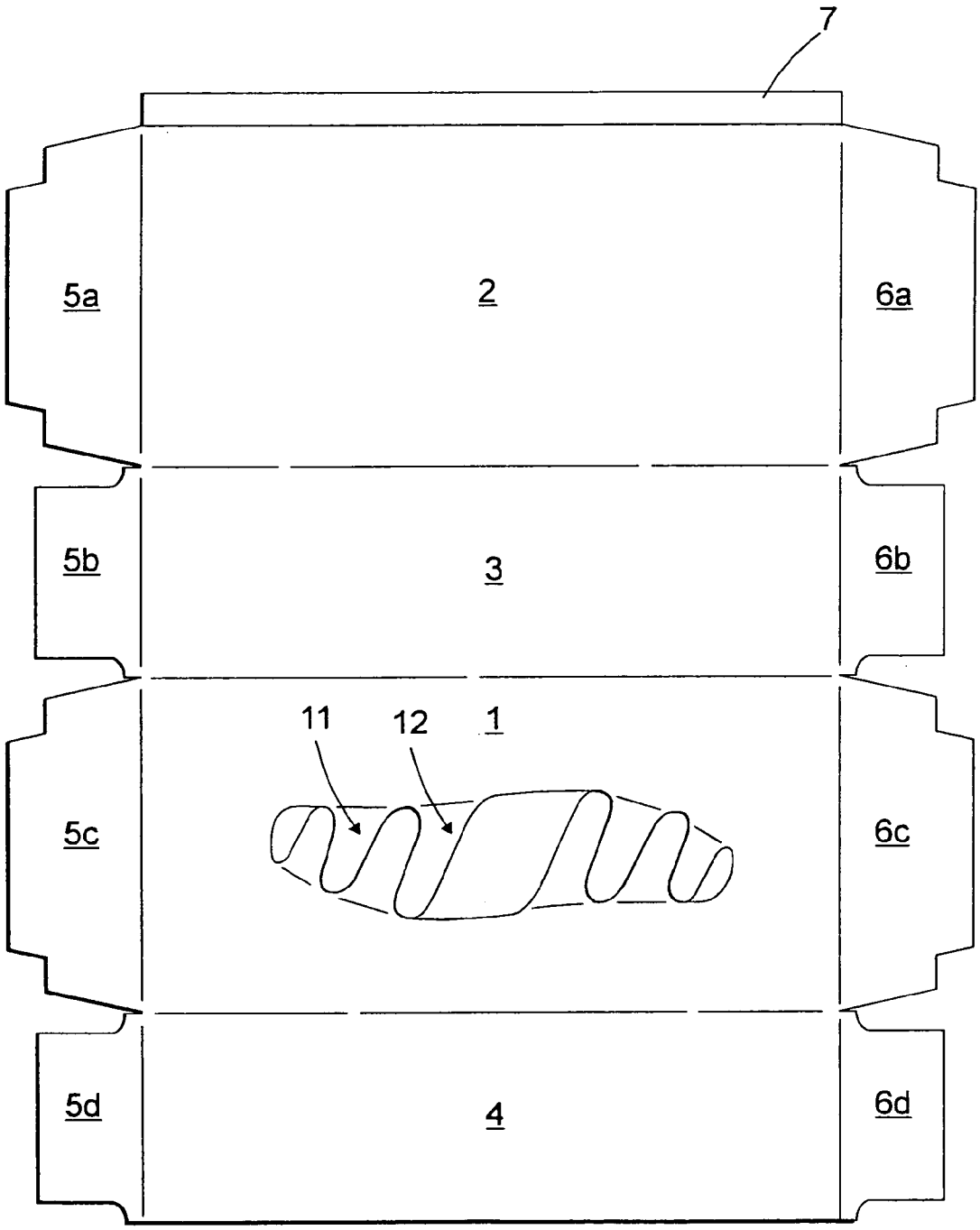
FIG. 6 shows a plan view of a blank according to the first embodiment of the invention.

Furthermore, a pre-cut cardboard blank that can be erected to form a box according to FIG. 2, is shown in FIG. 6.

FIG. 3 shows a cross-section through the box as shown in FIG. 2, at the transverse axis Y. This figure shows the top wall 1, bottom wall 2 and the two log side walls 3, 4 enclosing a stack of tissues T. In this case the top wall 1 comprises a single layer of cardboard, into which the line defining the projections has been cut. In this case the opening 10 would be defined by an embossed folding line 10*a*, 10*b* extending around the cut line defining the projections at the base of each projection.

The active position of the projections is indicated with dotted lines in FIG. 3. For clarity, only the first pair of projections 11", 12''' are shown along with an indication of the presented uppermost tissue $T_1$. In addition, the figure shows how the bottom wall 2 and one side wall 3 are attached together by means of a longitudinal, narrow flap 7 joined to said bottom wall 2.

Figure 4A:
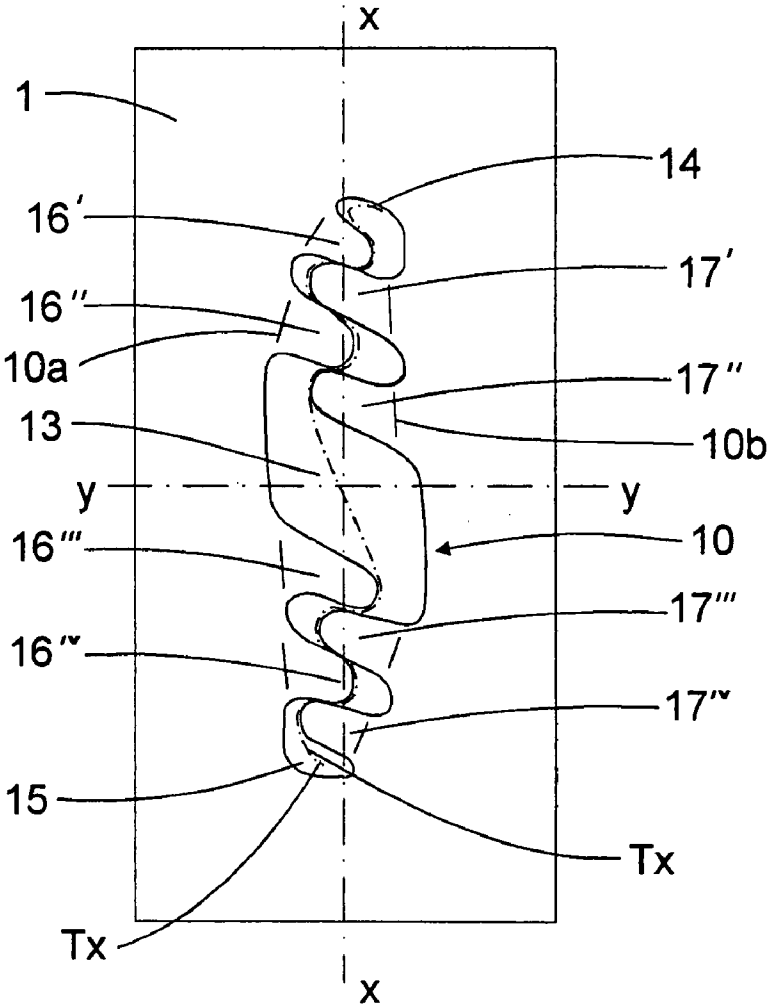
FIG. 4A shows a plan view of a box according to a first embodiment of the invention.

FIG. 4*a* shows a plan view of the overlapping projections in the subsequent, active position, after the first tissue-sheet has been pulled out of the box. When the first tissue is pulled up between the projections, they will flex and be raised upwards by the tissue. As the first tissue is removed from the box, the subsequent uppermost tissue will be pulled upwards into a dispensing position by the first tissue sheet.

Although the tissue sheets have the same width as the box, they can pass through the narrower opening without touching or being obstructed by the ends of the substantially oval opening 10. This is possible due to the controlled wrinkling effect of the projections on the tissue as it is pulled up between the projections. As the tissue is made from a thin, soft material, the resilient projections are able to assume an interdigitated position with the tips of adjacent, opposing projections 16', 16", 16''', 16$^{iv}$; 17', 17", 17''', 17$^{iv}$ extending past each other. Each projection will flex upwards and bend around their embossed folding lines 10*a*, 10*b*, indicated at the base of each projection. The central and outer cut-outs 13, 14, 15 have been described in connection with FIG. 2. The wrinkling imparted on the tissue by the projections can be described as substantially sinusoidal or wave-shaped in the region of the co-operating projections. Outside the outer projections and across the central opening 13 the shape of the tissue may be more random, but will still follow the general wave-shaped or partially sinusoidal character of the tissue in the region of the co-operating projections. An example of how the tissue may be shaped in the vicinity of the tips of the projections is indicated by a dotted line $T_X$ in FIG. 4*a*.The wave-shape imparted to the tissue sheet by the projections enables it to stay in an upright dispensing position, in spite of the thin and flimsy character of the material in the tissue.

A cut cardboard blank that can be erected to form a box as according to FIG. 4*a*, is shown in FIG. 6.

Figure 4B:
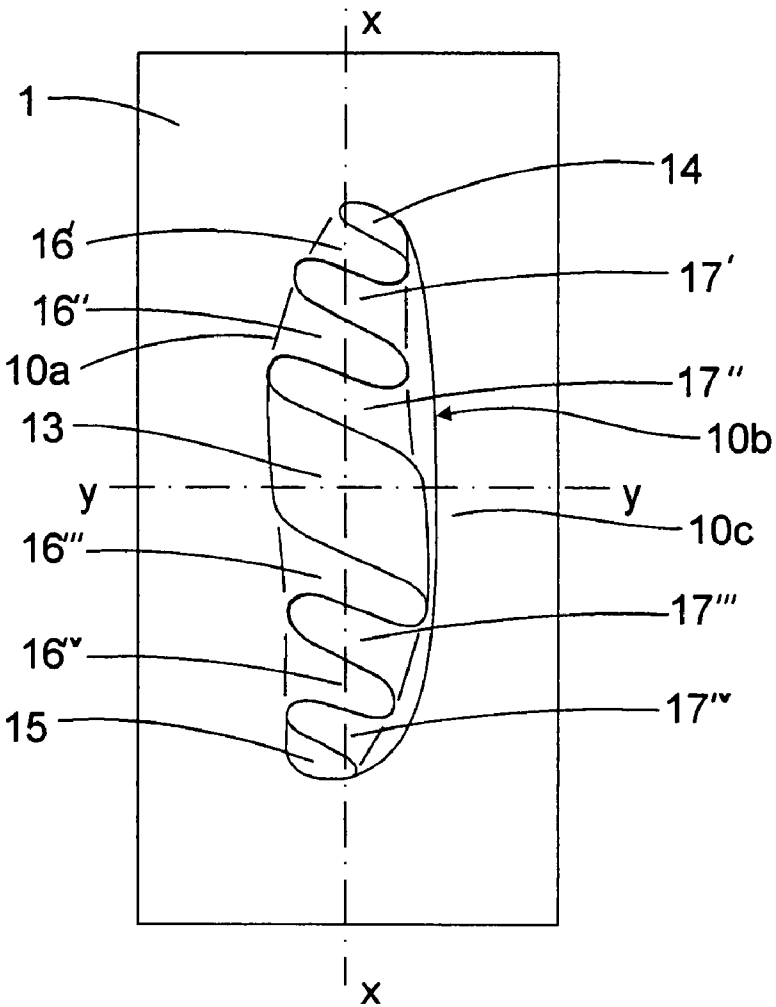
FIG. 4B shows a plan view of a box according to a second embodiment of the invention.

FIG. 4*b* shows a plan view of a second embodiment of the invention. Although the shape of the projections shown in FIG. 4*b* is the same as those shown in FIG. 4*a*, the box itself represents a further embodiment. This can be seen more clearly in FIG. 5, which shows a cross-section of the box in the transverse plane Y. According to this embodiment, the top wall 1 comprises two layers in the form of an upper top wall $\mathbf{1}_T$, provided with a first set of projections 16'–16$^{iv}$ and a lower top wall $\mathbf{1}_B$, provided with a second set of projections 17'–17$^{iv}$. These walls would normally be attached to each other by means of an adhesive or glue, but for clarity the layers are shown slightly separated in FIG. 5. In its unopened condition, the box shown in FIG. 4*b* would have a cover section (see FIG. 7; "18") covering the second set of projections 17'–17$^{iv}$, the central cut-out 13 and the outer cut-outs 14, 15 in cut the lower top wall $\mathbf{1}_B$. The box is opened by tearing off this cover section (not shown) is along a perforated line 10*c*, shown as a full line on the opened box in FIG. 4*b*.This full line represents a remaining edge in the upper top wall $\mathbf{1}_T$ after the removal of the cover section. The uppermost tissue sheet is then available through the opening provided by the central cut-out 13. As in the embodiment of FIG. 4*a*, the projections are provided with embossed folding lines 10*a*, 10*b* at the base of each projection.

Figure 7:
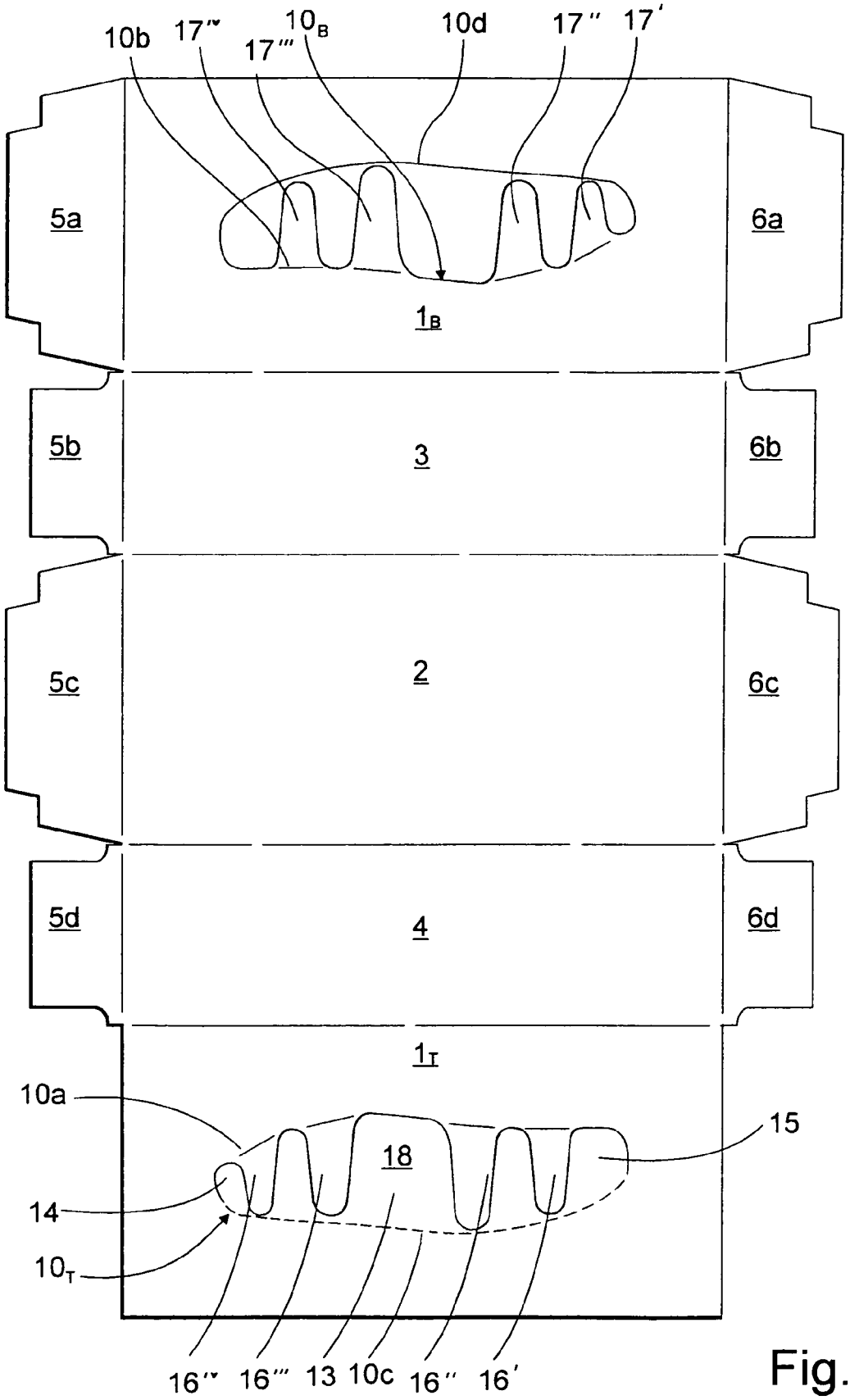
FIG. 7 shows a plan view of a blank according to the second embodiment.

A cut cardboard blank that can be erected to form a box as according to FIG. 4*b*, is shown in FIG. 7.

Figure 4C:
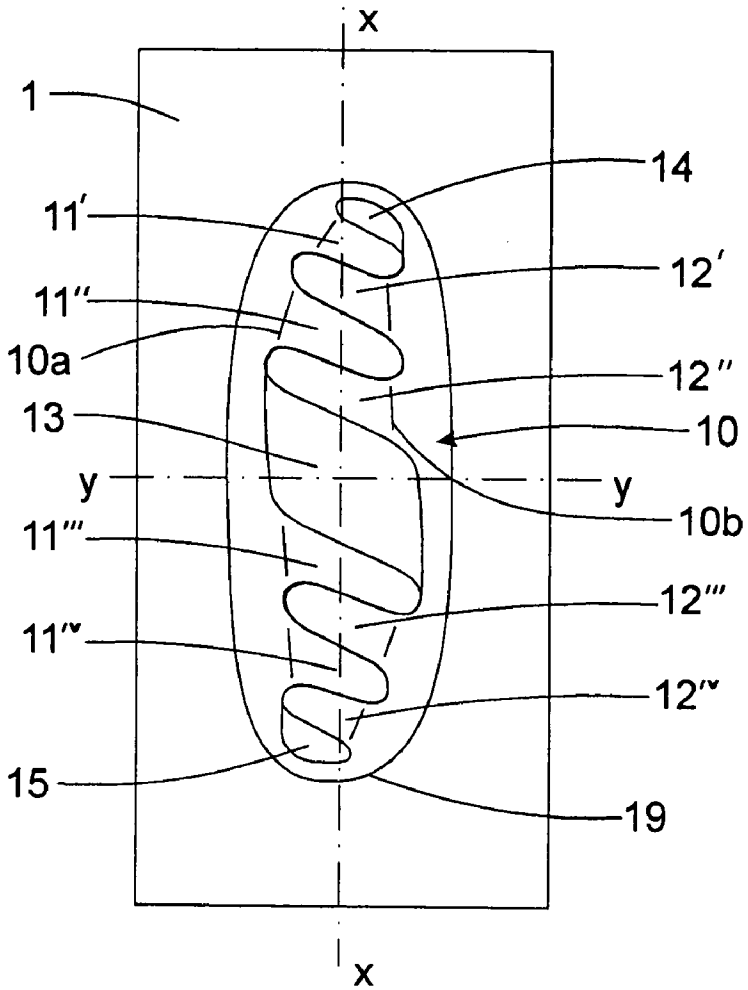
FIG. 4C shows a plan view of a box according to a third embodiment of the invention.
Figure 8:
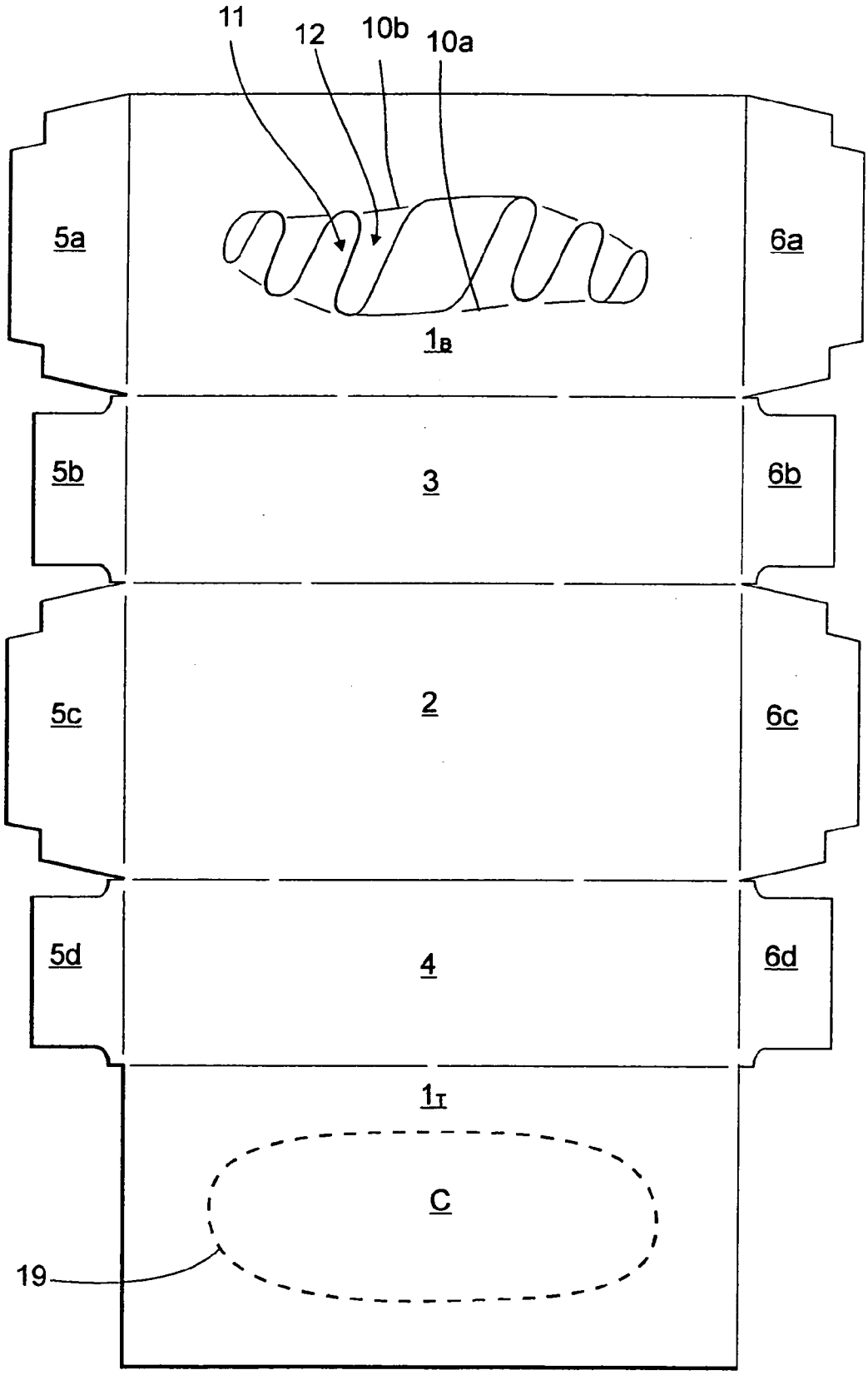
FIG. 8 shows a plan view of a blank according to the third embodiment of the invention.

FIG. 4*c* shows a plan view of a further, third embodiment of the invention, showing the overlapping, opposing projections in their inactive positions. The projections 16', 16", 16''', 16$^{iv}$; 17', 17", 17''', 17$^{iv}$ and the central and outer cut-outs 13, 14, 15 have been described in connection with FIG. 2 above. The embodiment of FIG. 4*c* differs from that of FIG. 4*a* in that the upper wall 1 is made up of two layers. The projections are placed in a lower layer, while an upper layer is provided with a cover section (not shown). The cover section (see FIG. 8, "C") is perforated around its outer periphery and is removed by the user when the box is opened, in order to expose the projections 16', 16", 16''', 16$^{iv}$; 17', 17", 17''', 17$^{iv}$ and the embossed folding lines 10*a*, 10*b*. The resulting opening in the upper layer is therefore larger than that the area enclosed by the embossed folding lines and has an edge 19 placed at a distance from said embossed folding lines. A blank that can be erected to form such a container is shown in FIG. 8.

Figure 4D:
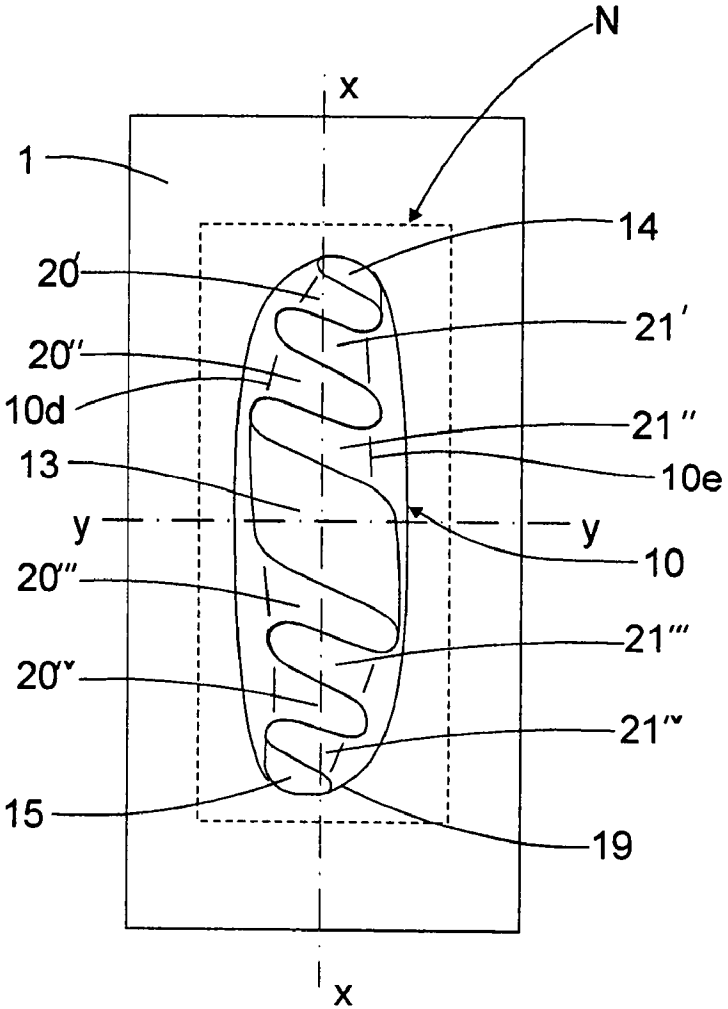
FIG. 4D shows a plan view of a box according to a fourth embodiment of the invention.

FIG. 4*d* shows a plan view of a fourth embodiment of the invention, showing the overlapping, opposing projections in their inactive positions. The projections 20', 20", 20''', 20$^{iv}$; 21', 21", 21''', 21$^{iv}$ and the central and outer cut-outs 13, 14, 15 are part of an insert N attached to the underside of the top wall 1. Similar to the embodiment described in connection with FIG. 4*c*, the top wall 1 would be provided with a cover section (not shown). The cover section has a perforated line 19 around its outer periphery, as in the embodiment of FIG. 4*c*.The cover is removed by the user when the box is opened, in order to expose the projections 20', 20", 20''', 20$^{iv}$; 21', 21", 21''', 21$^{iv}$ and the embossed folding lines 10*d*, 10*e*. As described above, all projections, cut-outs would be cut or punched as a single continuous line. The insert would also be provided with folding lines embossed directly onto the insert. The insert itself is preferably made from a suitable plastic material.

Figure 5:
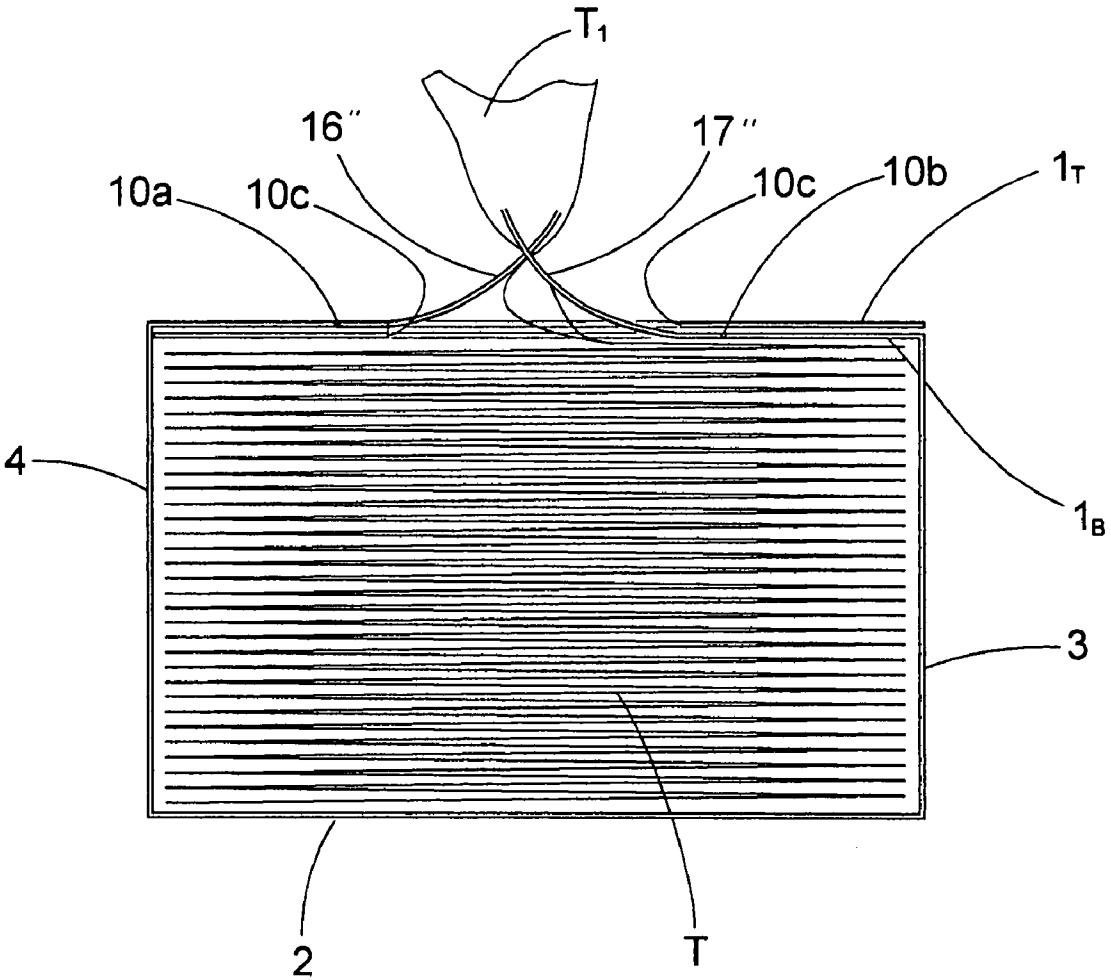
FIG. 5 shows a cross-section of a box containing a stack of tissues in accordance with the second embodiment of the invention.

FIG. 5 shows a cross-section of the box FIG. 4*b*. The cross-section shows the lower top wall $\mathbf{1}_B$, which is connected to the first long side wall 3 and folded over the stack of tissues T. The upper top wall $\mathbf{1}_T$, which is connected to the second long side wall 4 is folded over and attached to the lower top wall $\mathbf{1}_B$. A first set of projections 16'–16$^{iv}$ is part of he upper top wall $\mathbf{1}_T$ and extend from an embossed folding line defining the edge 10*a* of the opening. This first set of projections is defined by a cut line in the upper top wall $\mathbf{1}_T$. A section of the upper top wall $\mathbf{1}_T$, containing an opposing set of projections, a central cut-out and a pair of outer cut-outs, is a removable cover (see FIG. 7) having the same shape as a second set of underlying projections 17'–17$^{iv}$ in the lower top wall $\mathbf{1}_B$. When the box is first opened by a user, this cover is torn off along a partially cut and partially perforated line provided around its entire periphery, in order to expose a second set of projections 17'–17$^{iv}$. This second set of projections 17'–17$^{iv}$ is defined by a cut line in the lower top wall $\mathbf{1}_B$. Instead of using an embossed folding line, the edge of the opening 10 adjacent the base of the second projections is defined by a curved edge 10*c* in the upper top wall $\mathbf{1}_T$ that is exposed when said cover is removed. For clarity, only projections 16" and 17" are shown in FIG. 5.

A pre-cut blank for folding into a box similar to that shown in FIG. 4 will be described in more detail below, in connection with FIG. 7.

The embodiments described with reference to FIGS. 2–5 show projections extending symmetrically across the top wall, wherein the sets of opposing projections intersect at, or near, a vertical axis through the centre of the box. However, within the scope of the invention it is possible for the projections to intersect at a position removed from said vertical axis. This can be achieved either by using sets of projections each having different properties, such as stiffness, or by using opposing adjacent projections of unequal lengths.

FIG. 6 shows one possible embodiment of a precut blank that can be folded into a box as shown in FIGS. 1 and 2. The blank comprises a top wall 1, with associated side flaps 5*c*, 6*c*, a first side wall 3, with associated side flaps 5*b*, 6*b*, a bottom wall 2, with associated side flaps 5*a*, 6*a*, and a second side wall 4, with associated side flaps 5*d*, 6*d*.In addition, the bottom wall 2 is provided with a narrow flap 7 along its longitudinal side edge. Said narrow flap 7 is used for connecting the bottom wall 2 and second side wall 4 when the blank is erected. The opening 10 and the two sets of opposing projections 11, 12, as described in connection with FIG. 2 can be seen in the top wall 1.

In an alternative embodiment, the opposing projections can be part of an insert containing the cut or punched line defining the projections and the cut-outs 13, 14, 15. Such an insert 20 would be attached to the underside of the top wall 1, as indicated by a dotted line in FIG. 4*d*.For such an embodiment, the blank shown in FIG. 6 would simply be provided with a cover section perforated around its periphery placed in the top wall 1. This type of cover section is described further in connection with FIG. 8 below. In a later step, before the blank is erected, the pre-cut insert is attached to the underside of the top wall 1 by means of adhesive applied outside the periphery of the perforated line of the cover section.

In both of the above embodiments, the side flaps are folded in to create an end wall 5, 6 at either end of the box in a conventional manner.

FIG. 7 shows one possible embodiment of a precut blank that can be folded into a box as shown in FIGS. 4*b* and 5. The blank comprises an upper top wall $\mathbf{1}_T$, with associated side flaps 5*a*, 6*a*, a first side wall 3, with associated side flaps 5*b*, 6*b*, a bottom wall 2, with associated side flaps 5*c*, 6*c*, a second side wall 4, with associated side flaps 5*d*, 6*d*, and a lower top wall $\mathbf{1}_B$, without side flaps. The upper top wall $\mathbf{1}_T$ and the lower top wall $\mathbf{1}_B$ must be indexed to ensure proper alignment of the projections, as the walls are attached to each other when the blank is erected.

An upper opening $\mathbf{10}_T$ is provided with a first set of projections $\mathbf{16'}$–$\mathbf{16}^{iv}$ and a cover section 18, as described in connection with FIGS. 4*b* and 5, located in the upper top wall $\mathbf{1}_T$. As stated above, the cover section 18 has a shape corresponding to the combined surface of the second set of projections $\mathbf{17'}$–$\mathbf{17}^{iv}$ and the side and central cut-outs 13, 14, 15. For obvious reasons, the cover section 18 is only attached to the upper top wall $\mathbf{1}_T$ by means of a perforated line following the first set of projections 16, the cut-out sections 13, 14, 15 and a curved line 10*a* representing the edge of the opening 10. The lower top wall $\mathbf{1}_B$ is provided with a lower opening $\mathbf{10}_B$ having substantially the same basic shape as the upper opening $\mathbf{10}_T$. Said lower opening $\mathbf{10}_B$ is provided with a second set of projections $\mathbf{17'}$–$\mathbf{17}^{iv}$, which will fit between the first set of projections 16 when the box is erected. The remaining part of the opening $\mathbf{10}_B$ is defined by a line following the second set of projections $\mathbf{17'}$–$\mathbf{17}^{iv}$, the shape of the cut-out sections 13, 14, 15 and a curved line 10*d* representing the edge of the opening $\mathbf{10}_B$ opposing the projections $\mathbf{17'}$–$\mathbf{17}^{iv}$. This remaining part is cut out and removed before the blank is erected into a box.

In the above embodiment, the side flaps are folded in to create an end wall 5, 6 at either end of the box in a conventional manner.

FIG. 8 shows an alternative embodiment of the blank according to FIG. 7. This embodiment has been briefly described in connection with FIG. 4*c*. As can be seen in FIG. 8, the blank is provided with five panels $\mathbf{1}_T$, $\mathbf{1}_B$, 2, 3, 4, with associated side flaps 5*a*–*d*, 6*a*–*d*, as described in connection with FIG. 7 above. The main difference over the embodiment of FIG. 7 is that the bottom top wall $\mathbf{1}_B$ is provided with two sets of opposing projections 11, 12, each with associated embossed folding lines 10*a*, 10*b*, as described in connection with FIG. 2 above. The upper top wall $\mathbf{1}_T$ is provided with a removable cover section or lid C, which is perforated around its outer periphery as indicated by the line 19. When the cover section C is removed from the upper top wall $\mathbf{1}_T$, the opposed sets of projections 11, 12 and the embossed folding lines 10*a*, 10*b* are exposed, as can be seen in FIG. 4*c*. For this reason the perforated line 19 is positioned so that it will be placed a short distance outside c, that is between the embossed folding lines and the outer edges of the lower top wall $\mathbf{1}_B$.

This distance between the perforated line 19 and the embossed folding lines 10*a*, 10*b* depends on several parameters, such as the size of the box, etc., but may be between a few millimetres up to a few centimetres.

In a further embodiment it is also possible to let the edge of the perforated line 19 fulfil the function of the embossed folding lines, so that the edge determines the point at which the projections or fingers will flex. In that case, the size and shape of the cover section would be identical to that of the embossed folding lines shown in FIG. 4*c* and FIG. 8. This would eliminate the embossing step of the manufacturing process.

The positioning means and its projections are made from cardboard, a relatively thin plastic material, or some other suitable material. On one hand it must be sufficiently flexible to allow the user easy access to the first top tissue-sheet, but on the other hand it must also be sufficiently stiff to be able to support the tissue-sheet in a substantially upright position. Examples of suitable materials are plastics, such as polyethylene, paper, metal foil or laminated or coated materials e.g. polyethylene and paper. The choice of material depends on the configuration of the dispensing opening, the configuration of the projections and the type of tissue to be dispensed.

In a preferred embodiment the fingers are positioned substantially at right angles relative to the main longitudinal axis of the opening. In order to avoid interference between pairs of adjacent projections or fingers, it is important that they do not come into contact with each other when raised to their active, dispensing, positions. The purpose of the projections is to achieve a controlled wrinkling of a tissue sheet to be dispensed, whereby the tissue sheet itself is supported by the individual projections without any assistance from a gripping action between adjacent projections.

Figure 9C:
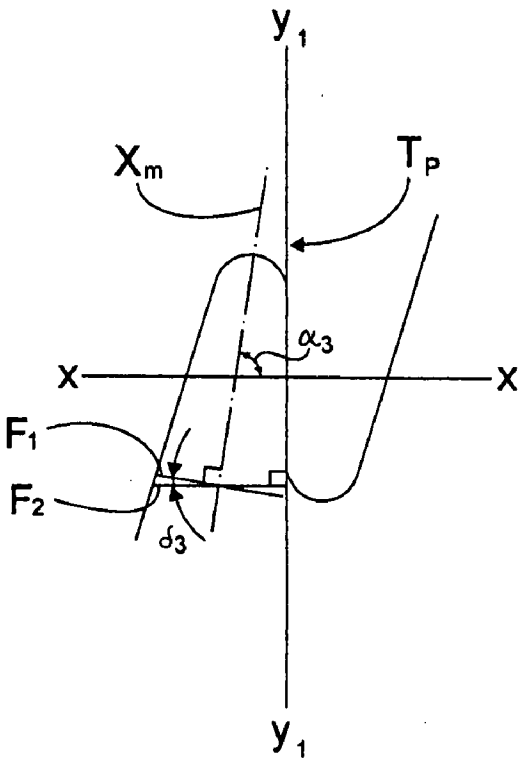
FIG. 9C shows a plan view of a third type of projections.
Figure 9B:
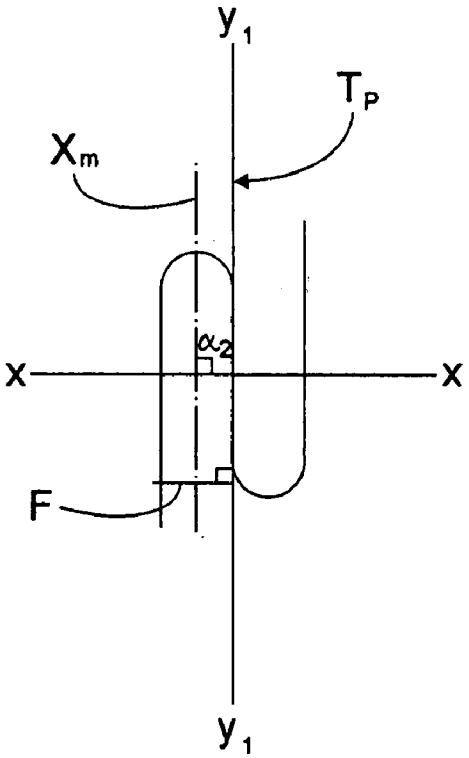
FIG. 9B shows a plan view of a second type of projections.
Figure 9A:
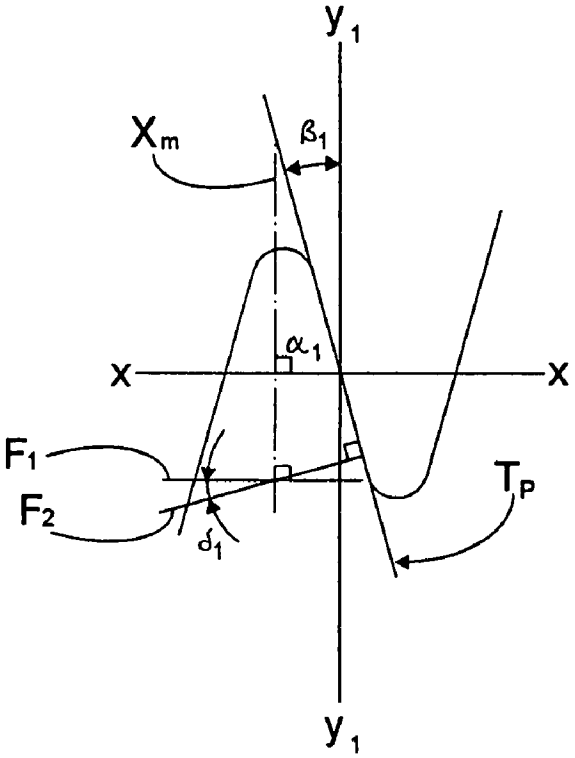
FIG. 9A shows a plan view of a first type of projections.

FIGS. 9*a* and 9*b* shows projections positioned with the main axes $\alpha$ at right angles relative to the main longitudinal axis X of the opening, with the projections having tapered (FIG. 9*a*) and parallel sides (FIG. 9*b*) respectively. The desired function is achieved by means of a folding line either parallel to said longitudinal axis or following the general edge of the opening (not shown). Such fingers or projections can be identified by the fact that a perpendicular line $Y_1$ through the longitudinal axis X at the point $P_1$ where the edges of a pair of adjacent fingers cross said axis will not intersect said fingers. In other words, said perpendicular line $Y_1$ will cross the outer edge of each finger only once. In FIG. 9*a* it can be seen that the position of the folding line may be varied between a first folding line $F_1$ perpendicular to the main $X_M$ axis of the projection, and a second folding line $F_2$ perpendicular to a tangent $T_P$ to a common point of contact between two edges. In this case the first folding line can be varied an angle δ equal to the angle α of the main axis $X_M$ of the projection with respect to the longitudinal axis X minus the angle β of the tangent $T_P$ with respect to the perpendicular line $Y_1$.

In the case of FIG. 9*b*, the tangent $T_P$ and the perpendicular line coincides, which means that the folding line $F_1$ should be placed at right angles to the main axis $X_M$ of the projection in order to avoid interference.

FIG. 9*c* shows a special case, wherein a tangent $T_P$ to a common point or line of contact between two edges coincides with said perpendicular line $Y_1$.

Figure 9D:
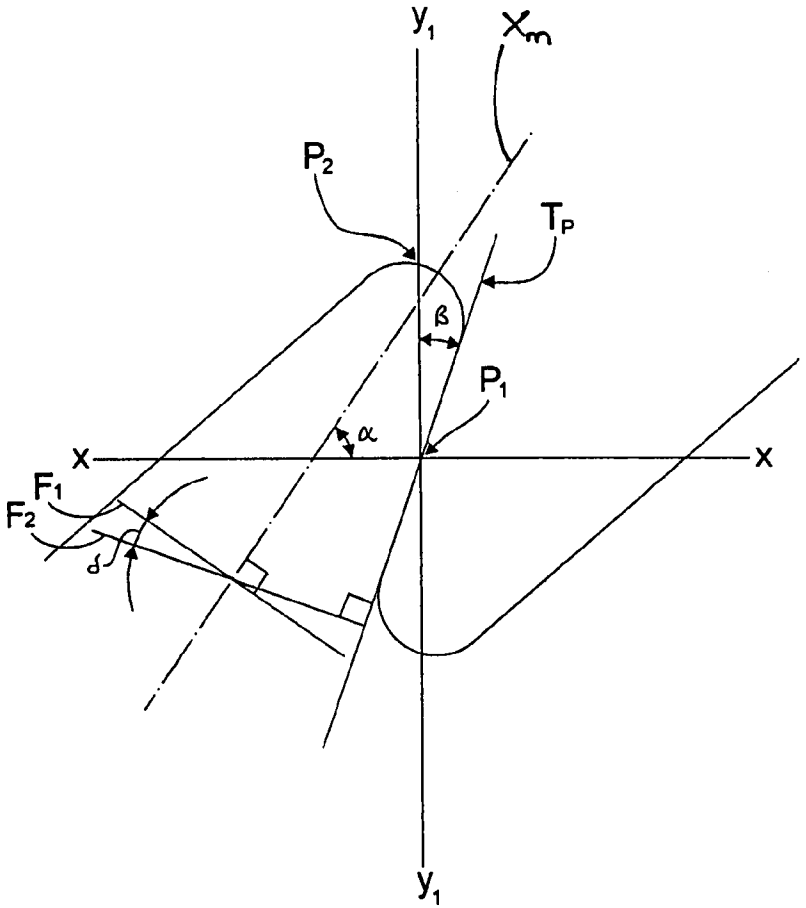
FIG. 9D shows a plan view of a fourth type of projections.

However, fingers or projections that are angled relative to the main longitudinal axis of the box may risk interference when raised to the dispensing position. Such fingers or projections can be identified by the fact that a perpendicular line through the longitudinal axis at the point where a the edges of a pair of adjacent fingers cross said axis will intersect said fingers. As shown in FIG. 9*d*, said perpendicular line will cross the outer edge of each finger more than once. In such cases the angle of the folding line, with respect to the main axis of the finger, may need to be adjusted.

For the embodiment described with reference to FIG. 9*d*, a first angle of the fingers is defined as the angle α between the longitudinal axis X of the opening and a main axis $X_M$, or centreline, through the current finger or projection. A second angle β, is equal to the angle between the perpendicular line $Y_1$ and the tangent $T_P$ for the current and an adjacent projection A third angle δ, is equal to the difference between the first α and the second angle β, i.e. $\delta=(\alpha-\beta)$. This third angle is the range within which the folding line of the current projection can be adjusted without causing interference with the adjacent projection. In FIG. 9*d*, a first folding line $F_1$ is shown at right angles to the main axis $X_M$ of the projection, while a second folding line $F_2$ is rotated an angle d relative to the first folding line $F_1$. The position of the respective folding lines $F_1$ and $F_2$ along the main axis $X_M$ of the projection is determined by the required stiffness and/or other desired properties of the projection.

The third angle δ, can vary from a minimum value of 0°, for parallel fingers, to a maximum value as said tangent. $T_P$ approaches an angle of 90° to the longitudinal axis X of the opening. This third angle δ will always be less than said first angle α.

In a further preferred embodiment the fingers are angled between 60° and 90° relative to the main longitudinal axis X of the opening.

Using fingers or projections having said first angles α arranged at less than said 60° is possible. However, due to side forces imposed on the fingers in the direction of the main longitudinal axis X of the opening by a tissue sheet being pulled from the box, interference between adjacent fingers may occur even if the above conditions are met.

In FIGS. 9*a–d* the pairs of projections are drawn symmetrical for clarity. However, as can be seen from the previous figures, opposing, adjacent fingers or projections are not necessarily identical. For this reason the position of the respective folding lines must be determined individually for each projection. This is especially true when a projection is placed between a pair of adjacent projections.

Note also, that all angles referred to in the above text are measured in the inactive position of the fingers or projections, unless otherwise specified.

The invention is not limited to the above embodiments, but may be varied within the scope of the appended claims.

The invention claimed is:

1. A container for a collection of interfolded tissue-sheets (T), said container comprising:

a generally planar top wall (1);

a bottom wall (2);

side walls (3, 4, 5, 6) connecting said bottom wall (2) with said top wall (1); and an opening (10) provided in at least said top wall (1) for the removal of said tissue-sheets (T) from the container, said stack (T) of interfolded tissue-sheets being placed in said container with at least a pair of edges of a lowermost tissue-sheet placed on said bottom wall (2) and an uppermost tissue-sheet (T1) placed near or in contact with the top wall and adjacent to the opening in the top wall, which opening (10) is provided with elongated, overlapping projections (11, 12; 16'–16$^{iv}$; 17'–17$^{iv}$) extending from opposite sides of the opening (10), wherein, each projection has a tip terminating the projection before an edge of an opposing side of the opening, and the tips of adjacent projections extend past each other both in an inactive position, and wherein all projections are placed in the same or in parallel planes, and in an active dispensing position, wherein the projections are raised upwards to grip a tissue.

2. A container according to claim 1, wherein said adjacent overlapping projections (11, 12; 16'–16$^{iv}$; 17'–17$^{iv}$) are arranged to extend past each other on both sides of a tissue to impart a controlled wrinkling to said tissue.

3. A container according to claim 1, wherein said adjacent projections (11, 12; 16'–16$^{iv}$; 17'–17$^{iv}$) impart a substantially wave-shaped cross-section to the tissue in the region of the tips.

4. A container according to claim 1, wherein said overlapping projections (11, 12; 16'–16$^{iv}$; 17'–17$^{iv}$) are arranged opposite and at an angle (α) relative to the longitudinal axis of the opening (10) on both sides of the dispensing opening (10).

5. A container according to claim 4, wherein the projections are angled between 60° and 90° relative to the longitudinal axis of the opening (10).

6. A container according to claim 4, wherein the projections on the same side of the opening (10) are angled away from each other on either side of a central, transverse plane (Y) through the middle of the opening (10).

7. A container according to claim 6, wherein the angle (α) of the projections decreases with the distance from said transverse plane (Y).

8. A container according to claim 1, wherein the projections are positioned at right angles relative to the longitudinal axis of the opening (10).

9. A container according to claim 1, wherein all projections are part of the top wall and the projections are defined by a single cut line through said top wall.

10. A container according to claim 1, wherein a first set of projections (16'–16$^{iv}$) are part of an upper top wall ($\mathbf{1}_T$) and a second set of projections (17'–17$^{iv}$) opposing said first set, are part of a lower top wall ($\mathbf{1}_B$) and the first and second sets of projections are defined by a single cut line through their respective top wall.

11. A container according to claim 10, wherein a removable cover section (18) covering the set of projections (17'–17$^{iv}$) in the lower top wall ($\mathbf{1}_B$) has been cut in the upper top wall ($\mathbf{1}_T$).

12. A container according to claim 11, wherein the projections (17'–17$^{iv}$) in the lower top wall ($\mathbf{1}_B$) extend from an edge (10*c*) of the opening in the upper top wall ($\mathbf{1}_T$), which edge is exposed when said cover section has been removed.

13. A container according to claim 1, wherein a first and a second set of projections (16'–16$^{iv}$, 17'–17$^{iv}$) are part of a lower top wall ($\mathbf{1}_B$) and an upper top wall ($\mathbf{1}_T$) is provided with a removable cover (C) over said projections.

14. A container according to claim 1, wherein all projections (2O'–2O$^{iv}$, 21'–21$^{iv}$) are part of an insert (N) attached to the underside of the top wall (1) and the upper top wall ($\mathbf{1}_T$) is provided with a removable cover (C) over said projections.

15. A container according to claim 1, wherein each projection (11, 12; 16'–16$^{iv}$, 17'–17$^{iv}$; 20'–20$^{iv}$, 21'–21$^{iv}$) is provided with an embossed folding line (10*a*, 10*b*, 10*d*, 10*e*) near or at the base of said projections.

* * * * *